US011597114B2

(12) United States Patent
Kiley et al.

(10) Patent No.: US 11,597,114 B2
(45) Date of Patent: Mar. 7, 2023

(54) EDGE GUIDE

(71) Applicant: Velocity, A Managed Services Company, Inc., Holland, OH (US)

(72) Inventors: Greg Kiley, Miami, FL (US); Bradley Chesler, Holland, OH (US)

(73) Assignee: VELOCITY, A MANAGED SERVICES COMPANY, INC., Holland, OH (US)

( * ) Notice: Subject to any disclaimer, the term of this patent is extended or adjusted under 35 U.S.C. 154(b) by 38 days.

(21) Appl. No.: 17/355,636

(22) Filed: Jun. 23, 2021

(65) Prior Publication Data

US 2021/0316466 A1 Oct. 14, 2021

Related U.S. Application Data

(62) Division of application No. 16/592,861, filed on Oct. 4, 2019, now Pat. No. 11,077,572.

(60) Provisional application No. 62/741,248, filed on Oct. 4, 2018.

(51) Int. Cl.
*B26B 25/00* (2006.01)
*B26B 29/00* (2006.01)

(52) U.S. Cl.
CPC ..... *B26B 25/007* (2013.01); *B26B 29/00* (2013.01)

(58) Field of Classification Search
None
See application file for complete search history.

(56) References Cited

U.S. PATENT DOCUMENTS

| | | | | |
|---|---|---|---|---|
| 623,000 | A | 4/1899 | Erkenbreck | |
| 4,062,116 | A * | 12/1977 | Arnott | B26D 3/10 30/292 |
| 6,282,794 | B1 | 9/2001 | Cho et al. | |
| 7,290,340 | B2 | 11/2007 | Lin | |
| 7,434,319 | B2 | 10/2008 | Tsai-Lin | |
| 7,870,675 | B1 * | 1/2011 | Della Polla | B26B 29/00 30/294 |
| 8,590,163 | B1 | 11/2013 | Bagley et al. | |
| 10,850,413 | B2 | 12/2020 | Mortensen | |
| 11,077,572 | B2 * | 8/2021 | Kiley | B26B 25/005 |
| 11,400,612 | B2 * | 8/2022 | Papenfuss | B26B 29/06 |
| 2004/0187318 | A1 | 9/2004 | Mathieu et al. | |
| 2007/0022615 | A1 | 2/2007 | Tsai-Lian | |
| 2008/0155838 | A1 | 7/2008 | Bergstrand | |
| 2008/0201960 | A1 | 8/2008 | Watanabe | |
| 2010/0071522 | A1 | 3/2010 | Otto | |
| 2011/0283546 | A1 | 11/2011 | Abreu et al. | |
| 2013/0014394 | A1 | 1/2013 | Chen | |
| 2014/0144027 | A1 | 5/2014 | Roth et al. | |
| 2019/0240853 | A1 | 8/2019 | Mortensen | |
| 2020/0108517 | A1 | 4/2020 | Kiley et al. | |
| 2021/0316466 | A1 * | 10/2021 | Kiley | B26B 25/007 |

* cited by examiner

*Primary Examiner* — Hwei-Siu C Payer
(74) *Attorney, Agent, or Firm* — Michael E. Dockins; Shumaker, Loop & Kendrick, LLP

(57) ABSTRACT

A hand-held rotary cutter assembly for cutting material includes a blade receptacle having a first surface having an indentation formed therein. An edge guide is received in the indentation. The edge guide includes a continuous linear edge. A blade engages the edge guide. The edge guide and the blade are configured to move simultaneously and linearly from a first position to a second position. A segmented portion of the blade extends outwardly from the continuous linear edge of the edge guide.

17 Claims, 4 Drawing Sheets

EDGE GUIDE

CROSS REFERENCE TO RELATED APPLICATIONS

This application claims the benefit of U.S. Provisional Application No. 62/741,248, filed on Oct. 4, 2018, and of U.S. patent application Ser. No. 16/592,861, filed on Oct. 4, 2019, now U.S. Pat. No. 11,077,572. The entire disclosures of the above-identified applications are hereby incorporated herein by reference.

FIELD

The invention relates to a rotary cutter for cutting a material. More particularly, the invention relates to a rotary cutter with an edge guide.

BACKGROUND OF THE INVENTION

As known, rotary cutters are used to cut material such as fabric, for example, or other material such as vinyl, plastic, metal, etc. They may be used in industrial, commercial, or home settings for the cutting. One or more layers of fabric may be cut at a time. For example, when cutting fabric, a piece of fabric is laid flat such as upon a measuring board or other surface. Rotary cutters are typically used against a rigid device to cut a material along a substantially straight edge. A rigid device such as a ruler or guide may be disposed upon the material to guide the rotary cutter in straight line in order to provide a straight cut for the material. Rotary cutters are relatively inexpensive means that provide for improved precision and speed compared to scissors and the like. Rotary cutters may be configured to receive different sized blades. For example, the rotary cutters may be configured to receive 28 millimeter rotary blades, 45 millimeter rotary blades, or 60 millimeter rotary blades.

Examples of rotary cutters can be found in U.S. Pat. Appl. Pub. No 2008/0201960, U.S. Pat. Appl. Pub. No. 2010/0071522, and U.S. Pat. No. 8,590,163, the disclosures of which are hereby incorporated herein by reference in their entirety.

However, there is a need to further improve the accuracy of cutting material with the rotary cutter such as in a straight line. Additionally, often, when using a rigid surface for cutting the material, the rotary cutter may damage the rigid surface due to the blade inadvertently, by user error or otherwise, deviating from a straight line. Furthermore, maintaining and improving safety of the rotary cutters is desired.

Accordingly, there exists a need to provide an edge guide for facilitating accurate cutting of material with a rotary cutter that minimizes damage to guides or surfaces and is easily assembled with a rotary cutter, while also facilitating safe cutting and ease of assembly of the rotary cutter.

SUMMARY OF THE INVENTION

In accordance and attuned with the present invention, an edge guide for facilitating accurate cutting of material with a rotary cutter that minimizes damage to guides or surfaces and is easily assembled with a rotary cutter, while also facilitating safe cutting and ease of assembly of the rotary cutter has surprisingly been discovered.

According to an embodiment of the disclosure, an edge guide for a hand-held material rotary cutter includes a thin body having a first planar surface configured for receiving a blade and a second planar surface opposing the first planar surface. The second planar surface is configured to engage a blade receptacle of the rotary cutter. A circular portion defines a first portion of the body. A continuous linear edge is formed at a portion of the circular portion. The continuous linear edge is configured for guiding the rotary cutter in a linear direction.

According to another embodiment, a hand-held rotary cutter assembly for cutting material is disclosed. The rotary cutter includes a blade receptacle having a first surface. The first surface includes an indentation formed therein. An edge guide is received in the indentation. The edge guide has a first planar surface, a second planar surface opposing the first planar surface, and a linear edge extending between the first planar surface and the second planar surface. A disc-shaped blade engages the first planar surface of the edge guide.

According to yet another embodiment of the disclosure, a hand-held rotary cutter assembly for cutting material is disclosed. The rotary cutter includes a blade receptacle having a first surface. The first surface includes an indentation. A blade is coupled to the blade receptacle. The indentation is configured to receive the blade and permit the blade to move linearly from a first position to a second position. An edge guide is removably coupled to and disposed intermediate the blade and the blade receptacle. The edge guide simultaneously and linearly moves with the blade from the first position to the second position. The edge guide includes a circular portion for engaging the blade and a flanged portion extending from the circular portion. The circular portion has a linear edge and the flanged portion has a linear edge continuous with the linear edge of the circular portion.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical. As used herein, substantially is defined as "to a considerable degree" or "proximate" or as otherwise understood by one ordinarily skilled in the art. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters. Where any conflict or ambiguity may exist between a document incorporated by reference and this detailed description, the present detailed description controls. Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
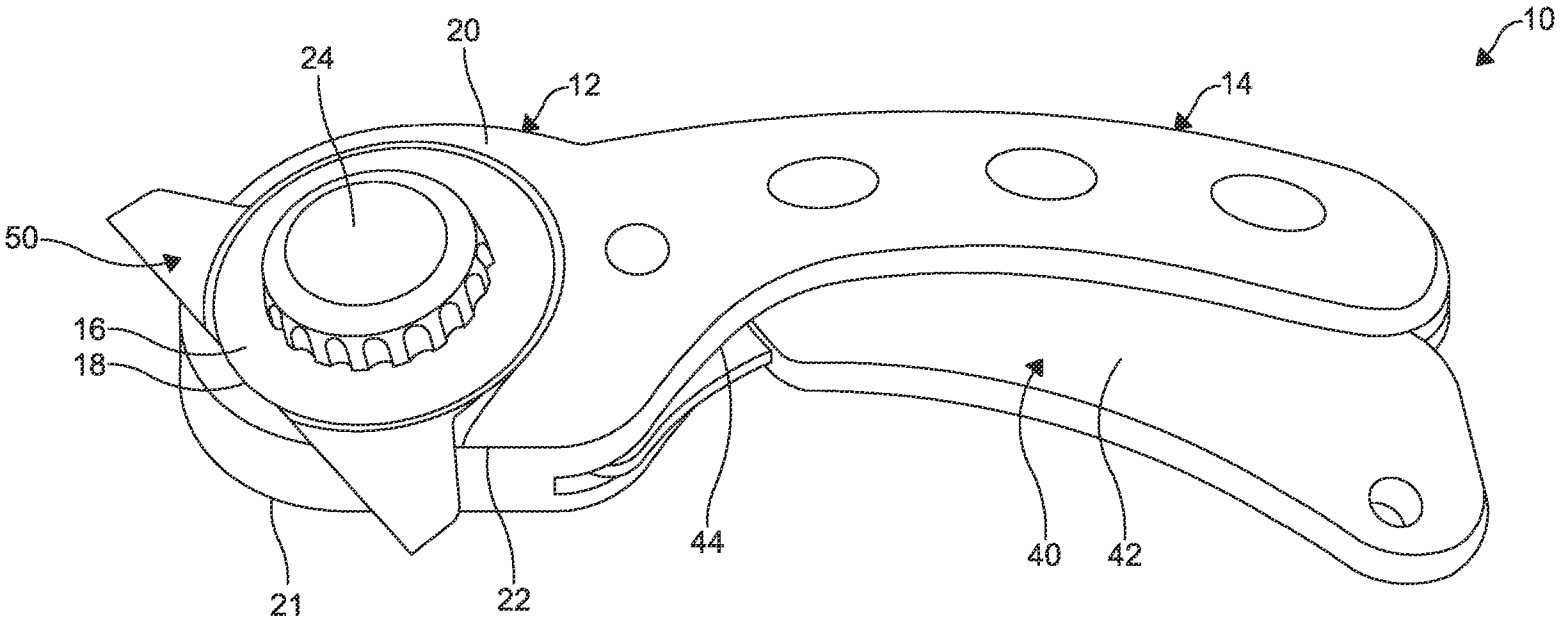
FIG. 1 is a front perspective view of a rotary cutter according to an embodiment of the disclosure, wherein a blade and an edge guide are positioned in a first position.
Figure 2:
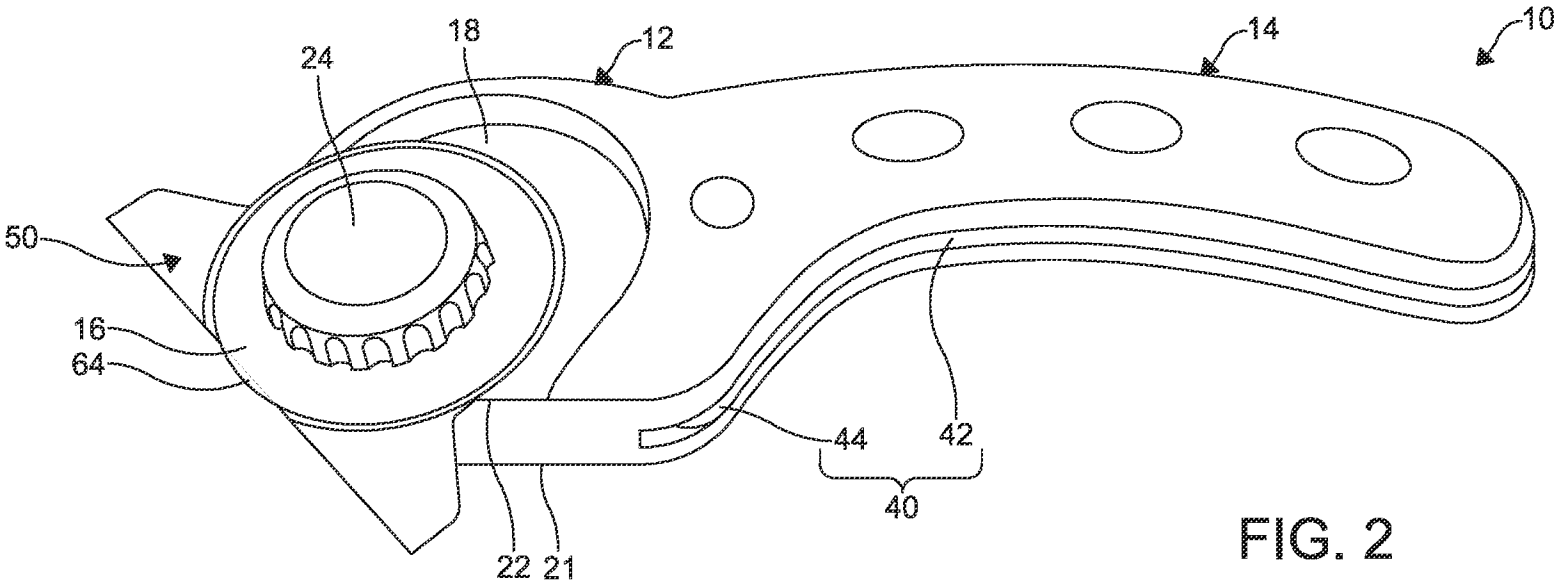
FIG. 2 is a front perspective view of the rotary cutter of FIG. 1, wherein the blade and the edge guide are positioned in a second position.
Figure 3:
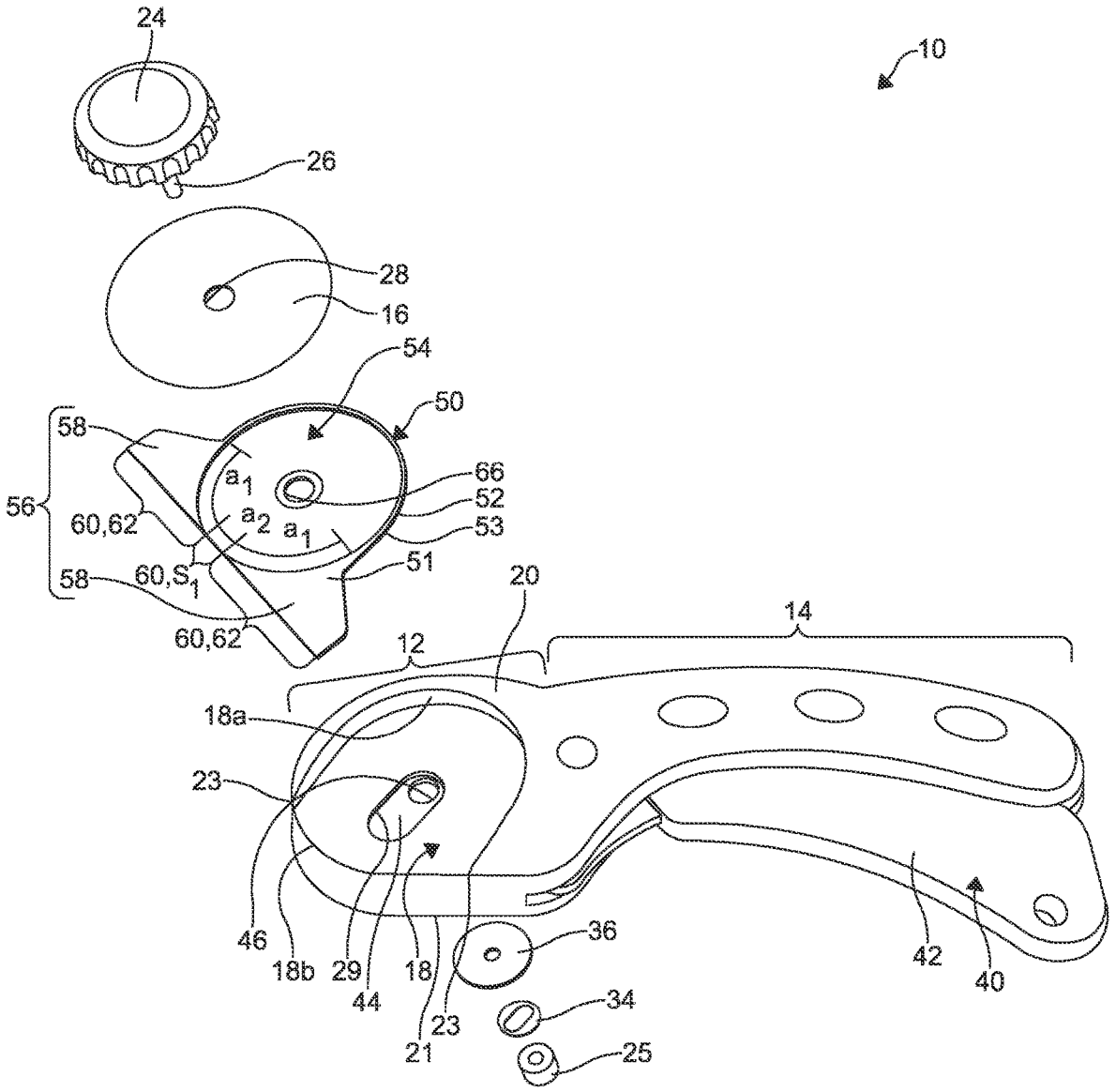
FIG. 3 is a partially exploded top perspective view of the rotary cutter of FIGS. 1-2.

FIGS. 1-3 illustrate a rotary cutter 10 according to an embodiment of the disclosure. The rotary cutter 10 is hand-held and configured for cutting or scoring thin pieces of material such as fabric, for example. Although, it is understood the rotary cutter 10 can cut other thin sheets of materials as well such as vinyl, sheet metal, glass, plastic, or any other material depending on the sharpness, hardness, and strength of the rotary cutter 10.

The rotary cutter 10 includes a blade receptacle 12, a handle 14 extending from the blade receptacle 12, and a blade 16. In the embodiment illustrated, the blade receptacle 12 is integrally formed with the handle 14. However, the blade receptacle 12 can be separately formed from the blade receptacle 12 and attached to the blade receptacle 12 by couple means such as a pin, screw, bolt, ball and detent, interference fit, or the like.

The blade receptacle 12 has a substantially planar first surface 20, an opposing second surface 21, and a side 22 extending between the surfaces 20, 21. An indentation 18 is formed on the first surface 20 of the blade receptacle 12 to receive the blade 16. The indentation 18 has an arch-shaped cross-sectional shape with a width substantially equal to a diameter of the blade 16. The shape of the indentation 18 permits the blade 16 to slide with respect to the surface 20 along a plane extending along the surface 20. Although, depending on the type of the rotary cutter 10 or shape of the blade receptacle 12, the indentation 18 can have other cross-sectional shapes such as circular, ovular, oblong, parabolic, or any other shape permitting the blade 16 to slide. A first end portion 18*a* of the indentation 18 forms an arcuate partition configured as a stop for the blade 16. A second end portion 18*b* extends to the side 22 to permit the blade 16 to extend outwardly from the blade receptacle 12. The indentation 18 cooperates with the side 22 at the first end portion 18*a* to form stops 23.

In the embodiment illustrated, the blade 16 is a thin flat disc-shaped rolling razor blade with a sharp outer perimeter configured to cut the material. However, the blade 16 can be a disc-shaped wave blade, pinking blade, or any other decorative or utility blade, if desired. The blade 16 is received in an edge guide 50 (discussed in further detail herein below) which is then received in the indentation 18. The blade 16 and the edge guide 50 are retained to the blade receptacle 12 by a cap 24 and a nut 25. The cap 24 includes a threaded stem 26 that extends through a central hole 28 formed in the blade 16 and a slot 29 that extends through the blade receptacle 12 from the first surface 20 of the blade receptacle 12 to the second surface 21 thereof. The threaded stem 26 threadingly engages the nut 25 to position the cap 24 in engagement with an outer surface of the blade 16 and the nut 25 in engagement with the second surface 21 of the blade receptacle 12. As a result, the blade 16 is compressed between the cap 24 and the edge guide 50 and the edge guide 50 is compressed between the blade 16 and the indentation 18, while still allowing for the blade 16 to rotate. Other components can be used such as a washer 34 and a spacer 36 to facilitate coupling of the blade 16 to the blade receptacle 12.

The blade 16 and the edge guide 50 translate or move from a first position (as shown in FIG. 1) to a second position (as shown in FIG. 2). In the first position, the blade 16 is in a storage configuration, wherein an entirety of the blade 16 remains within the outer perimeter of the blade receptacle 12. In the second position, the blade 16 moves into a cutting configuration, wherein a portion of the blade 16 extends from the outer perimeter of the blade receptacle 12 to expose the blade 16. In the second position, the blade 16 can be employed to cut the fabric.

The rotary cutter 10 includes a blade positioning mechanism 40 permitting the blade 16 and the edge guide 50 to move from the first position to the second position. In the embodiment illustrated, the blade positioning mechanism 40 is a handle press configured to move the blade 16 and the edge guide 50 from the first position to the second position when a user compresses the handle press against the handle 14. The blade positioning mechanism 40, as shown, includes a handle cooperating portion 42 aligning with the handle 14 and a blade receptacle portion 44 aligning with the blade receptacle 12. The blade positioning mechanism 40 is received in a slot formed in a side of the rotary cutter 10 to align each portion 42, 44 thereof with the respective ones of the handle 14 and the blade receptacle 12. As a result, the blade positioning mechanism 40 is positioned between the sides of the rotary cutter 10. A hole 46 is formed in the blade receptacle portion 44 to receive the threaded stem 26 extending therethrough, thus coupling the blade receptacle portion 44 to the blade 16 and the edge guide 50. The blade positioning mechanism 40 is biased outwardly from the handle 14, so the blade 16 is positioned in the first position. As a result, the blade positioning mechanism 40 can be compressed by a user towards the handle 14 in a first direction to move the blade 16 and the edge guide 50 in a second direction substantially opposite the first direction from the first position to the second position for cutting. The blade 16 and the edge guide 50 move along a direction of the slot 29 of the blade receptacle 12.

In the example shown, the rotary cutter 10 is similar to ergonomic handle type rotary cutters such as LIBAO® rotary cutter with ergonomic handle or OLFA® rotary cutters with ergonomic handle, for example. However, it is understood, the rotary cutter 10 can be similar to other types of rotary cutters such as straight handle rotary cutters such as OLFA® straight handle rotary cutters or FISKARS® straight handle rotary cutters, for example. In another example, the rotary cutter 10 can be similar to loop handle rotary cutters such as FISKARS® loop handle rotary cutters, for example. Although, any other type of the rotary cutter 10 can be employed as desired without departing from the scope of the disclosure. Therefore, it is understood, the blade positioning mechanism 40 can be other types of positioning features to move the blade 16 from the first position to the second position depending on the type of the rotary cutter 10. In a first example, the blade positioning mechanism 40 may be a slide directly or indirectly coupled to the blade 16 to move the blade 16 from the first position to the second position. In another example, the blade receptacle 12 can have a positioning plate that when pushed can extend the blade 16 outwardly from the blade receptacle 12, wherein the blade 16 can cut the material. In other embodiments, the blade positioning mechanism 40 can be configured as a button that permits the blade 16 to extend from the blade receptacle 12. Other blade positioning mechanisms can be employed as desired.

The edge guide 50 is positioned between the blade 16 and the blade receptacle 12. The edge guide 50 is a thin body that includes a first planar surface 51 opposing a second planar surface 53. The edge guide 50 has a substantially circular portion 52 for receiving the blade 16. The second planar surface 53 is configured to engage the indentation 18 of the blade receptacle 12. The circular portion 52 has an outer diameter substantially equal to the width of the indentation 18 of the blade receptacle 12. A recess 54 is formed in the first planar surface 51 at the circular portion 52 and is configured for receiving the blade 16. The recess 54 has a diameter substantially equal to a diameter of the blade 16. The edge guide 50 also includes a flanged portion 56. The flanged portion 56 includes a pair of wings 58 extending planar with the circular portion 52. Each of the pair of the wings 58 extend from a half portion of the circular portion 52, wherein the wings 58 extend from opposing first arcs $a_1$ of the circular portion 52 located between a center of the circular portion 52 and a second arc $a_2$ disposed intermediate the first arcs $a_1$. The circular portion 52 is segmented, or terminated, by a segment $S_1$ through the second arc $a_2$. The edge guide 50 terminates at a linear edge 60 extending from one end of a first one of the wings 58 to an opposing end of a second one of the wings 58. The linear edge 60 is perpendicular to the planar surfaces 51, 53 of the edge guide 50. Linear edges 62 of the wings 58 and the segment $S_1$ continuously form the linear edge 60.

The edge guide 50 includes a substantially centrally positioned aperture 66 formed therethrough for receiving the stem 26. The edge guide 50 extends outwardly and inwardly with respect to the outer perimeter of the blade receptacle 12 simultaneously with the blade 16 moving from the first position to the second position. Therefore, the edge guide 50 also moves from the first position to the second position. When disposed between the blade 16 and the blade receptacle 12, a portion 64 of the blade 16 extends beyond the linear edge 60 of the edge guide 50. In the first position, the circular portion 52 of the edge guide 50 is disposed within the outer perimeter of the blade receptacle 12 and the flanged portion 56 engages the stops 23. In the second position of the blade 16, the linear edge 60 and a portion of the circular portion 52 of the edge guide 50 are disposed outside of the perimeter of the blade receptacle 12.

To assemble the rotary cutter 10, the edge guide 50 is disposed within the indentation 18 formed in the blade receptacle 12. Particularly, the circular portion 52 is positioned in the indentation 18, wherein the aperture 66 aligns with the slot 29 of the blade receptacle 12. The blade 16 is then positioned in the recess 54, wherein the hole 28 of the blade 16 aligns with the slot 29 of the blade receptacle 12 and the aperture 66 of the edge guide 50. The cap 24 is positioned on top of the blade 16, wherein the stem 26 extends through the hole 28 of the blade 16, the aperture 66 of the edge guide 50, and the slot 29 of the blade receptacle 12. The stem 26 engages the nut 25 to secure the edge guide 50 and the blade 16 to the rotary cutter 10. In certain embodiments, such as shown, the blade positioning mechanism 40 can be positioned within the slot formed in the side of the rotary cutter 10, wherein the hole 46 of the blade positioning mechanism 40 aligns with the hole 28 of the blade 16, the aperture 66 of the edge guide 50, and the slot 29 of the blade receptacle 12. However, it is understood, the blade positioning mechanism 40 can be configured as other types of blade positioning mechanisms 40. Therefore, the assembly of the blade positioning mechanism 40 may vary depending on the type of the rotary cutter 10. For example, the rotary cutter 10 may be a straight handle rotary cutter, wherein a slide is directly or indirectly coupled to the blade 16 and moves the blade 16 linearly with respect to the handle 14. Therefore, depending on the type of blade positioning mechanisms 40, the assembly of the blade positioning mechanism 40 to the rotary cutter 10 may vary.

In application, the blade positioning mechanism 40 is employed by a user to move the edge guide 50 and the blade 16 simultaneously from the first position to the second position. In the second position, the segmented portion 64 of the blade 16 and the liner edge 60 extend outwardly from the blade receptacle 12. The rotary cutter 10 is positioned such that the blade 16 engages the material to be cut.

Figure 4:
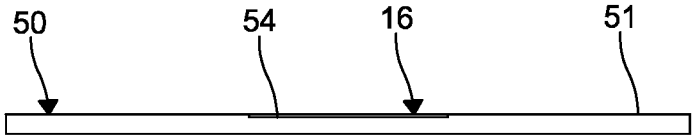
FIG. 4 is a view taken along a plane parallel to a linear edge of the edge guide of the rotary cutter of FIGS. 1-3, wherein the blade is received in the edge guide.

As shown in FIG. 4, the outer surface of the blade 16 is substantially flush with the first surface 51 of the edge guide 50 to ensure the blade 16 and the edge guide 50 both engage the guiding tool 100 to ensure accuracy of cuts. However, it is understood "substantially flush" means the outer surface of the blade 16 can extend minimally outwardly from the first surface 51 of the edge guide 50 to assure the outer surface of the blade 16 abuts the guiding tool 100. The minimal extension also allows for any tolerances in a thickness or change in the thickness of the edge guide 50 along a length of the edge guide 50 from the end of the first one of the wings 58 to the end of the second one of the wings 58. Additionally, "substantially flush" means the outer surface of the blade 16 can be spaced minimally inwardly into the recess 54 from the first surface 51 of the edge guide 50 to ensure the edge guide 50 is engaging the guiding tool 100. As used herein, with reference to the outwardly extension or the inward spacing of the outer surface of the blade 16 from the edge guide 50, minimally means "very small, or slight," or "the least possible," wherein the outer surface of the blade 16 extends outwardly or is spaced inwardly at a least possible distance that is enough to ensure any tolerances in the thickness of the edge guide 50 or the blade 16. The outer surface of the blade 16 being flush with the first surface 51 of the edge guide 50 ensures the blade 16 is precisely following the edge of the guiding tool 100. Additionally, the wings 58 can act as visual linear indicators for a user, since the wings 58 will be substantially flush with the outer surface of the blade 16. As a result, the path taken by the wings 58 of the edge guide 50, which span across the material to be cut at a length greater than a diameter of the blade 16, will accurately indicate the path of the blade 16. This is a result whether a guiding tool 100 is assisting the rotary cutter 10 or the rotary cutter 10 is being used freely without guidance from the guiding tool 100.

Figure 5:
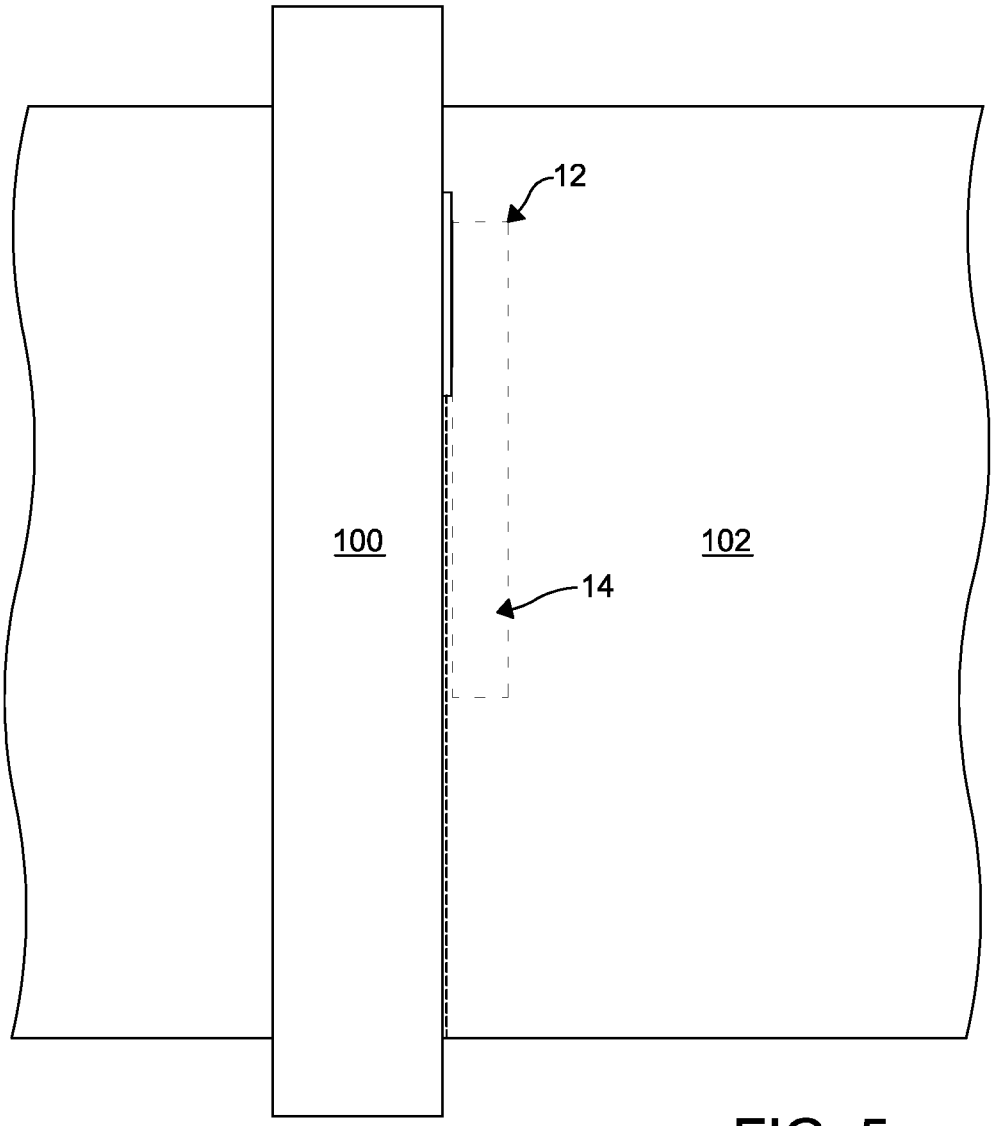
FIG. 5 is a schematic top plan view of the edge guide of the rotary cutter cutting a material against a guiding tool.

As shown in FIG. 5, the edge guide 50 can be placed against a guiding tool 100 such as a tool or ruler, for example, when cutting the material (indicated by reference numeral 102 in FIG. 5). The blade receptacle 12 and the handle 14 are generally and schematically represented by the dotted lines. Although, the guiding tool 100 can be any type of straight edged guide or curved guide as desired. The edge guide 50 keeps the blade 16 against the guiding tool 100. The linear edge 60 assists in directing and maintaining the blade 16 in a linear direction along the guiding tool 100. As a result, less error in linearity of the cut by the rotary cutter 10 occurs. Advantageously, the edge guide 50 also is configured as a guard to facilitate in guarding against exposure of the blade 16 and propensity to inadvertent cuts to a user. The linear edge 60 and recess 54 may also prevent the blade 16 from extending beyond a desired depth when employing the rotary cutter 10, thus preventing cuts from being too undesirably deep in a material 102, the guiding device 100, and/or surface used for cutting the material 102. The edge guide 50 is interchangeable with the rotary cutter 10 and various dimensions of edge guides can be employed. In other scenarios, the edge guide 50 can be easily removed from the rotary cutter 10 for use without the edge guide 50.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A hand-held rotary cutter assembly for cutting material comprising:

a blade receptacle having a first surface, the first surface including an indentation formed therein;

an edge guide received in the indentation, the edge guide including a continuous linear edge, wherein the edge guide includes a circular portion forming a first portion thereof and a wing forming a second portion thereof, and wherein the continuous linear edge segments the circular portion; and a blade engaging the edge guide.

2. The rotary cutter assembly of claim 1, wherein the edge guide includes a first planar surface and a second planar surface opposing the first planar surface, and wherein the continuous linear edge extends between the first planar surface and the second planar surface.

3. The rotary cutter assembly of claim 2, wherein the blade engages the first planar surface of the edge guide.

4. The rotary cutter assembly of claim 1, wherein the blade is disc-shaped.

5. The rotary cutter assembly of claim 1, wherein the edge guide and the blade move simultaneously and linearly from a first position to a second position.

6. The rotary cutter assembly of claim 5, wherein the blade is disposed within a perimeter of the first surface of the blade receptacle in the first position, and wherein the blade extends outwardly from the perimeter of the first surface of the blade receptacle in the second position.

7. The rotary cutter assembly of claim 5, wherein a blade positioning mechanism is in mechanical communication with the blade and the edge guide to cause the blade and the edge guide to move from the first position to the second position.

8. The rotary cutter assembly of claim 1, wherein a portion of the blade extends outwardly from the continuous linear edge of the edge guide.

9. The rotary cutter assembly of claim 1, wherein a recess is formed in the edge guide at the circular portion thereof, and wherein the blade is received in the recess.

10. The rotary cutter assembly of claim 9, wherein an outer surface of the blade is substantially flush with a first planar surface of the edge guide.

11. The rotary cutter assembly of claim 1, wherein the wing extends from the circular portion, and wherein at least a portion of the continuous linear edge is defined by the wing.

12. The rotary cutter assembly of claim 1, wherein the blade receptacle, the edge guide, and the blade are coupled together by a cap and nut configuration.

13. The rotary cutter assembly of claim 12, wherein the edge guide includes an aperture formed therein for receiving a stem formed on the cap.

14. The rotary cutter assembly of claim 1, wherein the edge guide is removably interchangeable with another respective edge guide, and wherein the blade is removably interchangeable with another respective blade.

15. The rotary cutter assembly of claim 1, wherein the indentation is configured to receive the blade and permit the blade to move linearly from a first position to a second position.

16. The rotary cutter assembly of claim 1, wherein the edge guide is removably coupled to and disposed intermediate each of the blade and the blade receptacle.

17. A hand-held rotary cutter assembly for cutting material comprising:

a blade receptacle having a first surface, the first surface including an indentation formed therein;

an edge guide received in the indentation, the edge guide including a continuous linear edge, wherein the edge guide includes a circular portion for engaging a blade and a flanged portion extending from the circular portion, wherein the continuous linear edge includes a first linear edge segmenting the circular portion and a second linear edge formed along the flanged portion; and the blade engaging the edge guide.

* * * * *